US005566925A

United States Patent [19]

Wada et al.

[11] Patent Number: 5,566,925

[45] Date of Patent: Oct. 22, 1996

[54] MANUAL CHAIN BLOCK

[75] Inventors: Yasuo Wada; Yoshio Ueno; Munenobu Honda, all of Osaka Sayama, Japan

[73] Assignee: Elephant Chain Block Company Limited, Osaka, Japan

[21] Appl. No.: 265,780

[22] Filed: Jun. 27, 1994

[30] Foreign Application Priority Data

Jul. 2, 1993 [JP] Japan ..... 5-164895
Aug. 9, 1993 [JP] Japan ..... 5-197518

[51] Int. Cl.[6] ..... B66D 1/28

[52] U.S. Cl. ..... 254/358; 254/372

[58] Field of Search ..... 254/358, 359, 254/372

[56] References Cited

U.S. PATENT DOCUMENTS

| | | | |
|---|---|---|---|
| 402,601 | 5/1889 | Lavery | 254/372 |
| 826,449 | 7/1906 | Steere | 254/358 |
| 1,993,744 | 3/1935 | Morison | 254/372 |
| 2,739,789 | 3/1956 | Smith | 254/372 |
| 3,030,076 | 4/1962 | Stevens . | |
| 3,092,369 | 6/1963 | Carroll . | |
| 3,894,720 | 7/1975 | Koji | 254/372 |
| 5,007,617 | 4/1991 | Nishimura | 254/372 |
| 5,125,629 | 6/1992 | Nishimura | 254/372 |

FOREIGN PATENT DOCUMENTS

| | | |
|---|---|---|
| 0602946 | 6/1994 | European Pat. Off. . |
| 1053220 | 2/1954 | France . |
| 62-16477 | 4/1987 | Japan . |

*Primary Examiner*—Katherine Matecki
*Attorney, Agent, or Firm*—Watson Cole Stevens Davis, P.L.L.C.

[57] ABSTRACT

In a manual chain block with a driving shaft a wheel cover 15 is provided with a radial bearing 18 for supporting the driving shaft 7 at one axial end portion. The driving shaft 7 has an actuating mechanism side shaft portion for supporting an actuating mechanism 20 extended so as to be supported by the radial bearing 18, so that shaft deflection can be decreased at the time of actuating operation of the actuating mechanism 20.

9 Claims, 10 Drawing Sheets

MANUAL CHAIN BLOCK

BACKGROUND OF THE INVENTION

1. Field of the Invention

The present invention relates to a manual chain block, and more specifically to a manual chain block having a load sheave supported rotatably between a pair of side plates to be driven interlockingly by a manual actuating mechanism having a hand wheel.

2. Description of Prior Art

Conventionally, for example as disclosed in the Japanese Utility Model Publication No. Sho. 62 (1987)-16477 and as shown in FIG. 22, a manual chain block has a load sheave 103 supported rotatably between a pair of side frames 101, 102. A driving shaft 104 is inserted into a shaft bore of the load sheave 103, and a hand wheel 105 which is part of an actuating mechanism is threadably engaged with axial one end of the driving shaft 104. The inside of the hand wheel 105 is connected to a driven hub 106 with a reverse prevention gear 107 and a pair of lining plates 108, 109 interposed between a flange portion of the driven hub 106 and the hand wheel 105 as well as a reverse prevention pawl 110 is pivotally mounted to the side frame 101 so as to engage with the reverse prevention 107, thus providing a transmission mechanism 111 with a mechanical brake. A reduction gear mechanism 112 is mounted to the axial other end of the driving shaft 104.

In addition to the above-mentioned construction, a wheel cover 113 for covering the transmission mechanism 111 and the hand wheel 105 is attached to the side frame 101, and a gear cover 114 for covering the reduction gear mechanism 112 is attached to the side frame 102. These covers 113, 114 are joined integrally to the side frames 101, 102 respectively by a stay bolt 115. A hook 116 is attached to upper portions of the side frames 101, 102 through an attachment shaft 117, and a chain kicker 118 is attached to lower portions thereof.

The driving shaft 104 arranged as mentioned above is supported rotatably at one axial end portion extending outward beyond the side frame 102 by a radial bearing 119 mounted to the gear cover 113 with its other axial end portion which extends outward beyond the side frame 101 being in the free state and threadably engaged with the hand wheel 105 and its intermediate portion being supported rotatably by a radial bearing 121 within a shaft bore of the load sheave 103. The transmission mechanism 111 and the hand wheel 105 are assembled onto the free end portion of the driving shaft 104 outside its supported portion.

Incidentally, numeral 122 in FIG. 22 designates a stopper for restraining axial movement of the hand wheel. Accordingly, the hand wheel 105 is threadably advanced by operating an endless hand chain (not illustrated) looped around the hand wheel 105 to further transmit to the driving shaft 104 a driving force transmitted from the hand chain to the hand wheel 105 through the transmission mechanism 111 and then transmit the driving force to the load sheave 103 through the reduction gear mechanism 112 so that cargo lifting can be carried out by winding up the load chain (not illustrated), a lifted cargo position can be held by the mechanical brake and a cargo lowering can be carried out by reversely operating the hand chain through the mechanical brake.

In the above-mentioned conventional construction, however, since the intermediate portion of the driving shaft 104 is supported by the load sheave 103 through the bearing 121, it is necessary to fit the bearing 121 into a small limited annular gap defined between an inner peripheral surface of the shaft bore of the load sheave 103 and an outer peripheral surface of the driving shaft 104. Therefore, since the size and type of the bearing 121 are so restricted that only a bearing having a poor bearing efficiency such as a needle bearing and a sleeve bearing can be employed, there is a problem that transmission efficiency of the driving force to the load sheave 103 becomes so poor that a larger operation force is needed for operation of the hand chain. Further, since the portion of the driving shaft 104 on the side of the actuating mechanism is not supported like a cantilever and provided at its free end with the hand wheel 105, the driving shaft 104 is deflected by a load acting on the hand wheel 105 when the wheel 105 is driven by the hand chain. Thereupon, when the hand chain is operated forcibly under that deflected condition of the driving shaft 104, there is also a problem that a bending stress is concentrated on the driving shaft 104 outside the load sheave 103 and its journal portion is deformed.

When the driving shaft 104 is deflected or deformed in that way, the hand wheel 105 is brought into contact with an inner surface of the wheel cover 113 or a component member such as a chain guide which is provided in the inner surface of the wheel cover 113. As a result, the transmission efficiency becomes much worse and an unpleasant noise is generated.

SUMMARY OF THE INVENTION

It is a principal object of the present invention to provide a manual chain block in which transmission efficiency can be improved, an operability of actuating mechanism can be improved and durability can be improved by decreasing shaft deflection or deformation of a driving shaft on the side of an actuating mechanism.

It is another object of the present invention to provide a manual chain block in which bearing efficiency can be improved so as to improve transmission efficiency.

It is a further object of the present invention to provide a manual chain block in which axial movements of a driving shaft can be restrained by a simple construction without lowering bearing performance and also overall durability can be improved while transmission efficiency can be improved and operability of an actuating mechanism can be improved by decreasing shaft deflection or deformation of a driving shaft on the side of an actuating mechanism.

According to the invention since the radial bearing 18 is provided on the side of the wheel cover 15 so that the shaft end portion of the driving shaft 7 on the side of the wheel cover 15 for supporting the actuating mechanism 20 can be supported by that bearing 18, it is possible to improve the supporting rigidity for the driving shaft 7. Therefore, even when a large operating load acts on the driving shaft 7 at the time of actuating operation of the hand wheel 8 of the actuating mechanism 20 through a hand chain, it is possible to decrease shaft deflection and to prevent shaft deformation. Thereupon, it is also possible to improve transmission efficiency attained when the driving force is transmitted from the hand wheel 8 to the load sheave 3 and to improve operability. Further it is possible to solve a problem which occurs when the hand wheel 8 is brought into contact with the chain guide or the wheel cover 15.

According to the invention since the radial bearings 18, 19 are disposed in the wheel cover 15 and the gear cover 16 respectively so that the axial opposed end portions of the driving shaft 7 can be supported by the wheel cover 15 and the gear cover 16 through the bearings 18, 19, namely by another supporting system aside from a supporting system for the load sheave 3, it is possible to employ a bearing which will have good bearing efficiency as well as desired dimensions, for example the type of ball bearings for either bearings 18, 19. Therefore, it is possible to further improve the transmission efficiency by enhancing the bearing efficiency. Thereupon, since the driving shaft 7 is supported at its axial opposite end portions, even when a large load acts on the driving shaft 7 at the time of actuating operation of the hand wheel 8, it is possible to decrease the amount of its shaft deflection as well as to prevent its shaft deformation. Accordingly, together with the improvement of the bearing efficiency it becomes possible to further improve the transmission efficiency to improve the operability of the hand wheel.

According to the invention since the wheel stopping member 40 is simply fitted onto the journal portion 72 of the driving shaft 7, the axial movement of the hand wheel 8 can be received by the wheel cover 15 through the outer ring 18*a* of the radial bearing 18. Therefore, it is possible to restrain the axial movement of the hand wheel 8 in the backward spiralling direction, namely the axial movement thereof at the time of excessive unwinding operation with a less deformation of the wheel cover 15 as well as to simplify the construction in Since the stopper 43 its disposed at a location on the driving shaft 7 outside the anchoring portion of the wheel stopping member 40, it is possible to leave the wheel stopping member 40 held in the driving shaft 7 even at the time of disassembly for removing the driving shaft 7 from the bearing 18 after dismount of the wheel cover 8.

Between the wheel cover 15 and the first side plate 1 to which the cover 15 is attached and between the gear cover 16 and the second side plate 2 to which the cover 12 is attached there are provided both positioning members for setting the positions of the covers 15, 16 relative to the side plates 1, 2 and positioning concaved portions adapted to engage with the positioning members respectively, when the wheel cover 15 and the gear cover 16 are attached to the the side plates 1, 2 respectively, the positions of the bearings 18, 19 can be set based on these side plates 1, 2. Therefore, it is possible to accurately align the axis of the driving shaft 7 to the axis of the load sheave 3 supported by the side plates 1, 2.

Since the radial bearing 18 is disposed on the side of the wheel cover 15 and the extended shaft portion of the driving shaft 7 on the actuating mechanism side is supported by the radial bearing 18 as well as the driving shaft 7 is supported by both the bearing 18 and a bearing interposed between the shaft bore 3*a* of the load sheave 3 and the driving shaft 7 passing through the shaft bore 3*a*, it is possible to improve the supporting rigidity for the shaft portion of the driving shaft 7 on the actuating mechanism.

Since the first and the second bearings 91, 92 are interposed between the the load sheave 3 and the driving shaft 7 passing through the shaft bore 3*a* of the load sheave 3 on the reduction gear mechanism side and on the actuating mechanism side respectively so that the driving shaft 3 can be supported at three points by the bearings 91, 92 and the radial bearing 18, it is possible to provide these bearings 91, 92 without serving to restrain the axial movement of the driving shaft 7 as well as to shorten the bearing span. Therefore, shaft deflection of the entire driving shaft can be restrained to improve the rotatability of the driving shaft 7 and to further improve the transmission efficiency.

Because the wheel cover 15 is provided with a concaved portion 58, an annular rib 59 and the plurality of reinforcement ribs 60 extending radially, it is possible to increase the rigidity of the wheel cover 15 without increasing its weight.

The reinforcement ribs 60 are so formed as to extend to the locations at which they are fixed to the first side plate 1 by the stay bolts 12, thus the position of the bearing 18 can be secured by the stay bolts 12 even when an impact load is imposed on the wheel cover 15 from outside.

DESCRIPTION OF THE PREFERRED EMBODIMENT

Figure 1:
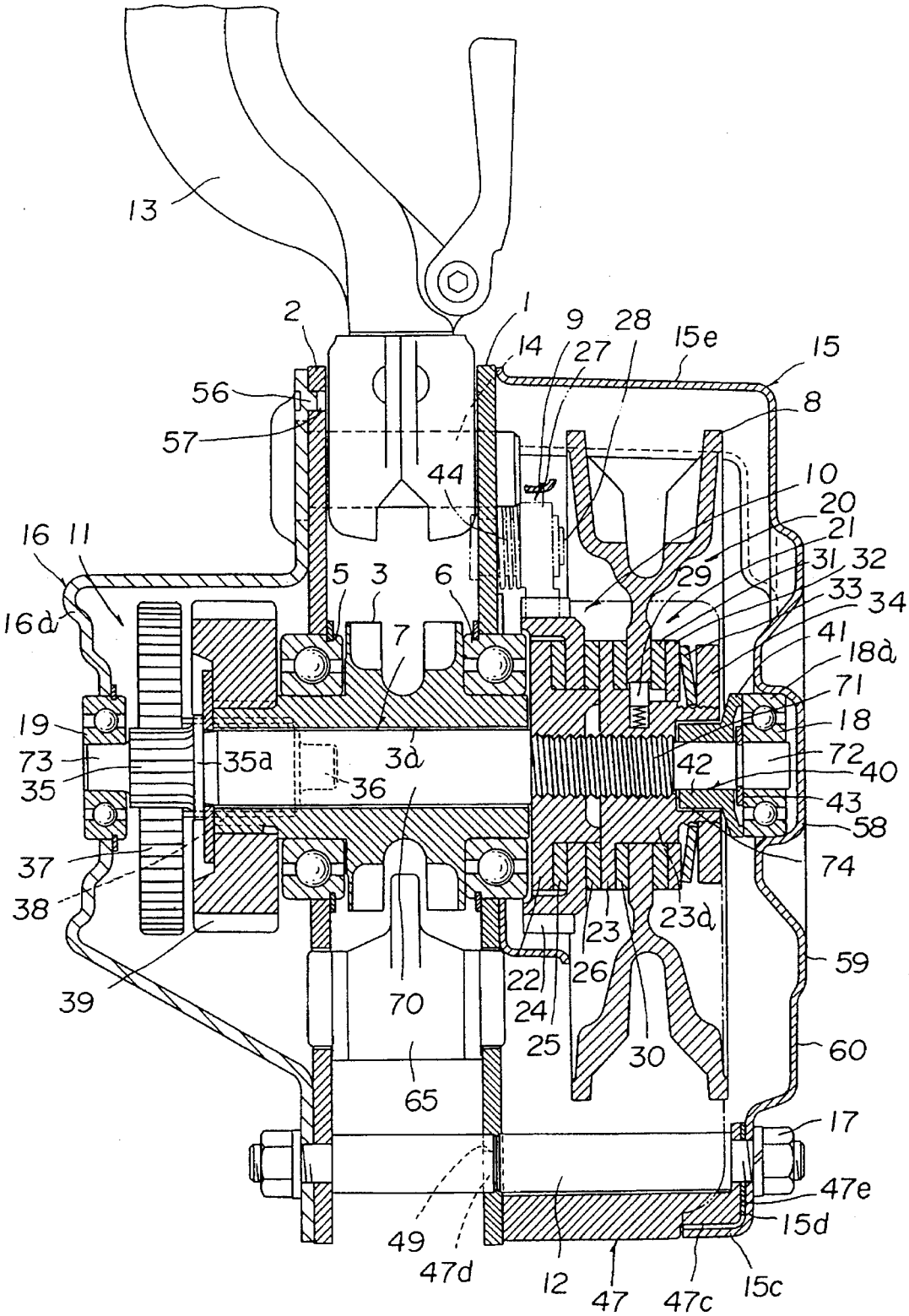
FIG. 1 is a vertical sectional view showing a first embodiment of a manual chain block according to the present invention.

A manual chain block illustrated in FIG. 1 is a manually operated lifting and lowering type chain block having a load sheave 3 which is supported rotatably between a pair of first and second side plates 1, 2 through bearings 5, 6 and around which a load chain 4 (FIG. 2) is looped. A driving shaft 7 is passed through a shaft bore of the load sheave 3. A hand wheel 8 around which an endless hand chain 80 (FIG. 8) is looped is disposed at an axial one end portion of the driving shaft 7, a transmission mechanism 10 provided with a mechanical brake 9 is disposed between the hand wheel 8 and the driving shaft 7, and a reduction gear mechanism 11 having a plurality of reduction gears is disposed at the axial other end portion thereof so that a driving force generated by actuating the hand wheel 8 through the hand chain can be transmitted to the load sheave 3 through the transmission mechanism 10 and the reduction gear mechanism 11 and then a handing member (not illustrated) comprising a hook and the like connected to the load chain 4 on its load side looped around the load sheave 3 can be lifted and lowered.

The side plates 1, 2 are fixed by secured by three stay bolts 12 while being spaced apart by a predetermined distance and an attachment shaft 14 for a hook 13 is mounted to side upper portions of both the side plates 1, 2 therebetween located in the tangential direction of the load sheave 3.

A wheel cover 15 for covering the hand wheel 8 is attached to the side plate 1 and fixed thereto by nuts 17 threadably engaged with the stay bolts 12 while a gear cover 16 for covering the reduction gear mechanism 11 is attached to the side plate 2 and also fixed thereto by the nuts 17.

Figure 2:
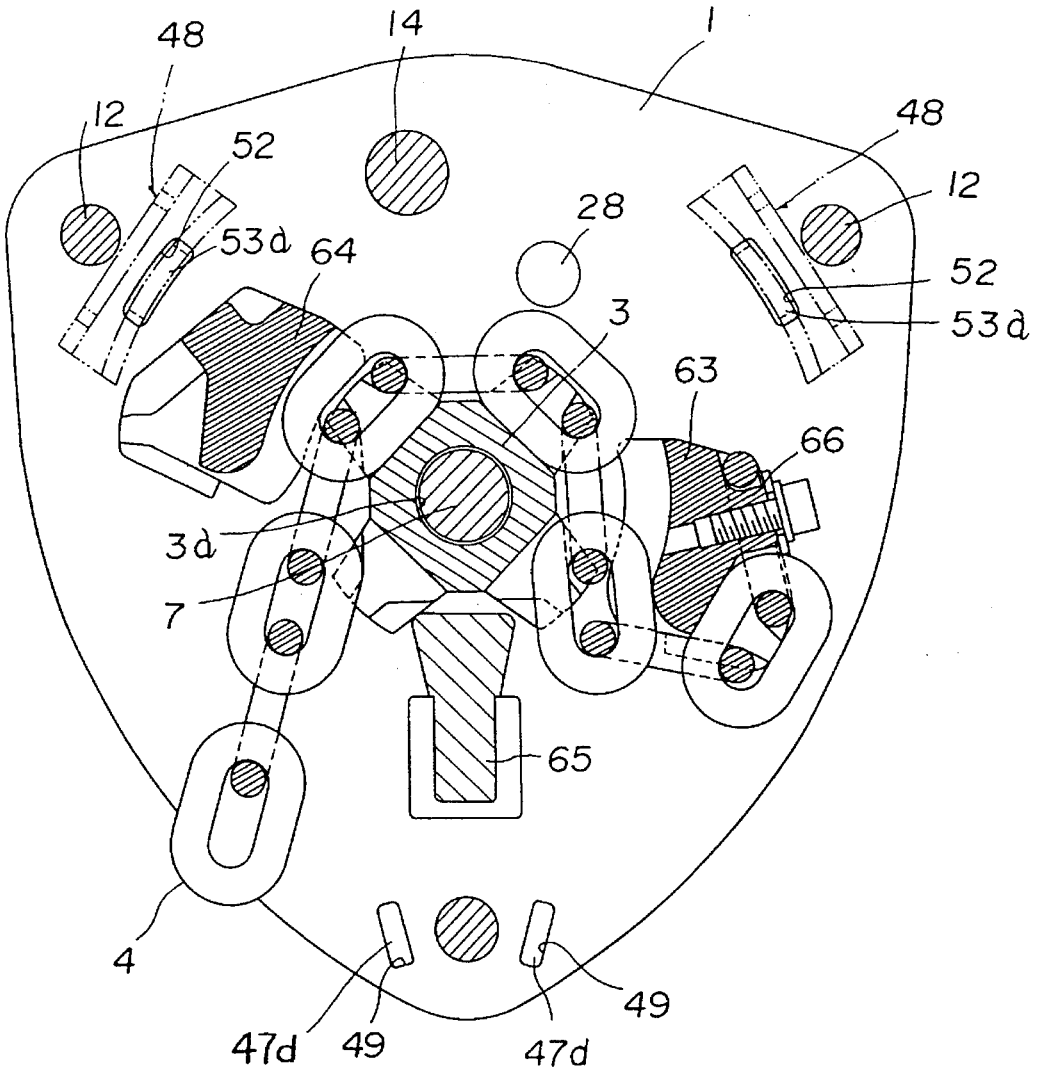
FIG. 2 is a sectional view taken along the middle plane between side plates showing a load chain looped around a load sheave.

The hand chain, the hand wheel 8 and the transmission mechanism 10 are part of an actuating mechanism 20, and the embodiment illustrated in FIGS. 1 and 2 provided with an overload prevention mechanism 21.

The transmission mechanism 10 comprises a driven hub 22 joined to the drive shaft 7 so as not to rotate relatively thereto (threadably joined to each other Figs.), a driving member 23 threadably engaged with the driving shaft 7, a reverse prevention gear 24 interposed between the respective flange portions of the driven hub 22 and the driving member 23 and supported rotatably by the driven hub 22 and lining plates 25, 26 interposed respectively between the driven hub 22 and the reverse prevention gear 24 and between the reverse prevention gear 24 and the driving member 23. A reverse prevention pawl 27 urged by a pawl spring 44 toward the reverse prevention gear 24 and meshed while the reverse prevention gear 24 is swingably mounted to the side plate 1 by the pawl shaft 28. This reverse prevention pawl 27, the reverse prevention gear 24, the driven hub 22, the driving member 23 and the lining plates 25, 26 comprise the mechanical brake 9.

The overload prevention mechanism 21 supports the hand wheel 8 by a cylindrical boss portion 23*a* of the driving member 23 through a one-way clutch 29 allowing it to rotate in the normal driving direction, and has a lining plate 30 disposed between the flange portion of the driving member 23 and a boss portion of the hand wheel 8, and also has a lining plate 31 and a press plate 32 which are rotatable together with the cylindrical boss portion 23*a*. A resilient member 33 comprising an initially coned disc spring fitted onto the cylindrical boss portion 23*a* of the driving member 23 outside the hand wheel 8, and an urging force setting adjuster 34 threadably are engaged with an end of the boss portion 23*a* outside the resilient member 33 to optionally set a slip load of the hand wheel 8 relative to the driving member 33 by adjusting an urging force of the resilient member 33.

Figure 3:
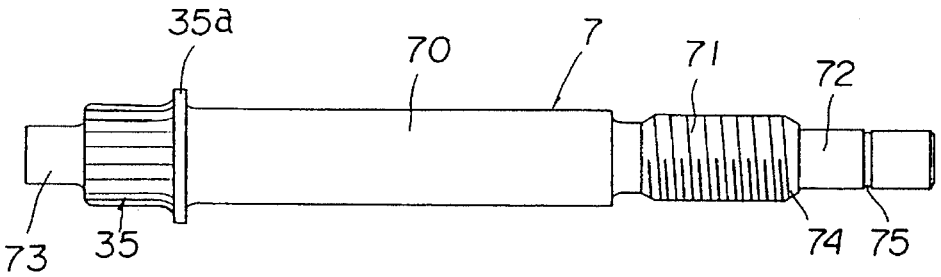
FIG. 3 is a front view showing only a driving shaft.
Figure 4:
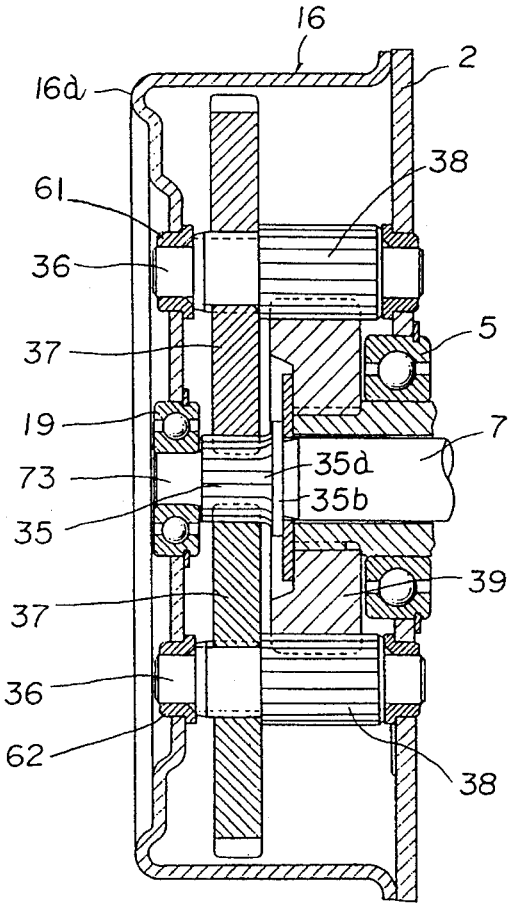
FIG. 4 is a partial horizontal sectional view showing only a reduction gear mechanism.

Further, the reduction gear mechanism 11 comprises a first gear 35 formed integrally with a shaft end of the driving shaft 7 shown in FIGS. 1, 3 and 4, a pair of second gears 37, 37 supported by intermediate shafts 36, 36 respectively so as to mesh with the first gear 35, a pair of third gears 38, 38 provided in the intermediate shafts 36, 36 and a fourth gear 39 connected to an extended portion of the load sheave 3 so as to mesh with the third gears 38, 38.

Thus, in the above mentioned construction, when the hand wheel 8 is driven in the normal direction by operating the hand chain, the driving shaft 7 is driven through the transmission mechanism 10 having the overload prevention mechanism 21 and the mechanical brake 9 so that the driving force is transmitted to the load sheave 3 through the reduction gear mechanism 11 to rotate the load sheave 3. Thereupon, the load side portion of the load chain 4 looped around the load sheave 3, namely the load side portion having a hook attached to its leading end thereof for hanging a cargo can be wound up to lift the cargo.

When a load larger than the slip load set by the adjuster 34 of the overload prevention mechanism 21 acts on the load side portion of the load chain 4 at the time of lifting the cargo, the hand wheel 8 slips relative to the driving member 23 so that the cargo lifting after that is stopped. Thereafter the level of the cargo lifted up to that point is held by an action of the mechanical brake 9.

When the lifted cargo is lowered, the hand chain is operated to drive the hand wheel 8 in the reverse direction. Thereupon, the driving member 23 is retreated due to a screw effect by the reverse driving of the hand wheel 8, so that the load sheave 3 is rotated reversely by alternately repeating an action and an inaction of the mechanical brake 9 to carry out the cargo lowering gradually.

The embodiment illustrated in FIG. 1 further has the following construction in addition to the manual chain block having the above-mentioned construction. That is, radial bearings 18, 19 generally comprising ball bearings are disposed in such portions of the wheel cover 15 and the gear cover 16 so as to be opposed to the driving shaft 7 and to rotatably support the axial opposite ends of the driving shaft 7 by the bearings 18, 19 separately from the load sheave 3 keeping a predetermined clearance between the shaft bore of the load sheave 3 and the driving shaft 7.

That is, the driving shaft 7 has an extended shaft portion on the actuating mechanism side for supporting the actuating mechanism 20, and its extended shaft portion is supported by the radial bearing 18. In the embodiment illustrated in FIG. 1, as shown in FIG. 3, the shaft portion on the actuating mechanism side comprises a threaded portion 71 adapted to threadably engage with both the driving member 23 rotated interlockingly with the hand wheel 8 and the driven member 22 and a journal portion 72 formed by extending an axial outer end portion of the threaded portion 71, and its journal portion 72 is supported by the radial bearing 18.

Also the axial other end portion of the driving shaft 7 on to which the reduction gear mechanism 11 of the driving shaft 7 is mounted has a journal portion 73 formed axially outside the first gear 35, and said journal portion 73 is supported by the radial bearing 19. While the driving shaft 7 is supported at its axial opposite end portions by the wheel cover 15 and the gear cover 16, the predetermined clearance is held between the intermediate portion 70 of the driving shaft 7 and the shaft bore 3*a* of the load sheave 3, so that it can be supported in the non-contact state separately from the load sheave 3 as another supporting system separated from that of the load sheave 3.

Therefore, it is possible to improve a supporting rigidity for the driving shaft 7. When the hand wheel 8 of the actuating mechanism 20 is actuated by the hand chain, it is possible to decrease the shaft deflection and to prevent a shaft deformation even though a large actuating load acts on the driving shaft 7. Further, since it is possible to improve the transmission efficiency of a driving force transmitted from the hand wheel 8 to the load sheave 3 and to improve the operability thereof while the shaft deflection can be decreased as well as the shaft deformation can be prevented in that way, it becomes possible to resolve a persistent problem involving noises which are generated by contact of the hand wheel 8 with the wheel cover or chain guides disposed inside of the wheel cover.

Thus, in the embodiment illustrated in FIG. 1, since the axial opposite end portions of the driving shaft 7 are supported by the bearings 18, 19 disposed in the wheel cover 15 and the gear cover 16, a bearing of the ball bearing type having a good bearing efficiency can be employed. Therefore, it becomes possible to improve the transmission efficiency by enhancing the bearing efficiency.

Additionally, in the embodiment illustrated in FIG. 1, between the shaft bore 3*a* of the load sheave 3 on the actuating mechanism side and the driving shaft 7 there may be disposed a bearing that is not always in contact but receives only the shaft deflection of the shaft portion on the actuating mechanism side.

The bearings 18, 19 may be attached to frames fixedly secured to the side plates 1, 2 instead of a direct attachment to each cover 15, 16.

The driving shaft 7 in the embodiment illustrated in FIG. 1 is provided with an actuating mechanism side shaft portion and a reduction gear mechanism side shaft portion between which the intermediate shaft portion 70 passes through the shaft bore 3*a* of the load sheave 3 as shown in FIG. 3. The actuating mechanism side shaft portion comprises the threaded shaft portion 71 and the journal portion 72 with the journal portion 72 being smaller in diameter than the threaded shaft portion 71. The driving shaft 7 has a receiving stepped portion 74 formed between the threaded shaft portion 71 and the support shaft portion 71. A fitting groove 75 for a stopper 43 is formed in an intermediate portion of the journal portion 72. The first gear 35 and the journal portion 73 which is smaller in diameter than the first gear 35 are formed in the reduction gear mechanism side shaft portion, and the first gear 35 is formed by a cold forging integrally is a flange portion 35*a*. A wheel stopping member 40 is fitted onto the journal portion 72 of the actuating mechanism side shaft portion. The wheel stopping member 40 comprises a restraint portion 41 opposed to the outer ring 18*a* of the radial bearing 18 held in wheel cover 15 to restrain the axial movement by abutting against the outer ring 18*a* and a receiving portion 42 engaged with the receiving stepped portion 74 to receive the axial movement of the hand wheel 8 through the driving member 23 threadably engaged with the threaded shaft portion 71.

Figure 6:
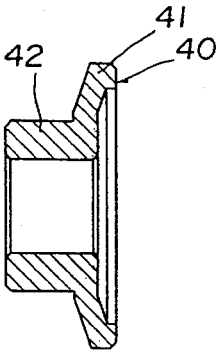
FIG. 6 is an enlarged sectional view showing only a wheel stopping member.

That is, the wheel stopping member 40 employed in the embodiment illustrated in FIG. 1 has a flange portion formed in a trumpet shape by expanding one end portion of a cylindrical member having a predetermined length as shown in FIG. 6, while the restraint portion 41 is formed by an outer periphery of the flange portion, the receiving portion 42 is formed by a lengthwise inside portion of the cylindrical member. An inner peripheral surface of the cylindrical member is not threaded but made straight and is fitted onto the journal portion 72 to be held thereby. The stopper 43 generally comprising a snap ring is anchored in the fitting groove 75 of the journal portion 72 outside the holding portion thereof for the wheel stopping member 40 so that an axially outward dismounting of the wheel stopping member 40 can be prevented by the stopper 43.

Thus, since the wheel stopping member 40 having the above-mentioned structure is merely stopped by the stopper 43 fitted in the journal portion 72, not only can the machining be simplified but also the mountability to the journal portion 72 can be simplified in comparison with a construction of the conventional embodiment in which a castle nut is threadably engaged with the driving shaft and stopped by a pin, so that the manufacturing cost can be decreased correspondingly. Thereupon, since the movement of the driving member 23 provided with the hand wheel 8 in the spiralling-back direction can be restrained by the receiving of the wheel cover 15 through the outer ring 18*a* of the bearing 18, it is possible to restrain the movement of the driving member 23 in the spiralling-back direction, namely to restrain the axial movement at the time of unwinding with less deformation of the wheel cover 15.

Since the stopper 43 is provided, it is possible to leave the wheel stopping member 40 held in the driving shaft 7 even at the time of disassembly for removing the driving shaft 7 from the bearing 18 after dismount of the wheel cover 8. Therefore, in case that the wheel stopping member 40 has been dismounted at the time of disassembly, it is difficult to forget to mount the wheel stopping member 40 at the time of reassemblage of the wheel cover 15. Even though the wheel cover 15 might be deformed by an excessive increase of the load acting on the wheel stopping member 40 at the time of restraining the axial movement through the outer ring 18*a* of the bearing 18, especially at the time of unwinding, it is possible to secondarily restrain the axial movement by the stopper 43. Accordingly, while deformation of the wheel cover 15 can be restrained, also axial movement can be effectively attained in co-operation with the wheel cover 15.

In the embodiment illustrated in FIGS. 1 and 6, since the wheel stopping member 40 is formed from a cylindrical member having the predetermined length, it can be employed so that its component parts can be used in common even in the case where the overload prevention mechanism 21 is constructed like the embodiment illustrated in FIG. 1 also in the case where the boss portion of the hand wheel 8 is threadably engaged with the threaded portion 71 without obstructing the overload prevention mechanism. In the ease where the boss portion of the hand wheel 8 is threadably engaged with the threaded portion 71 without obstructing the overload prevention mechanism, it is possible to simplify manufacturing of the hand wheel 8 because the axial movement can be restrained by the wheel stopping member 40 without elongating an axial length of the boss portion by employing the wheel stopping member 40.

Figure 12:
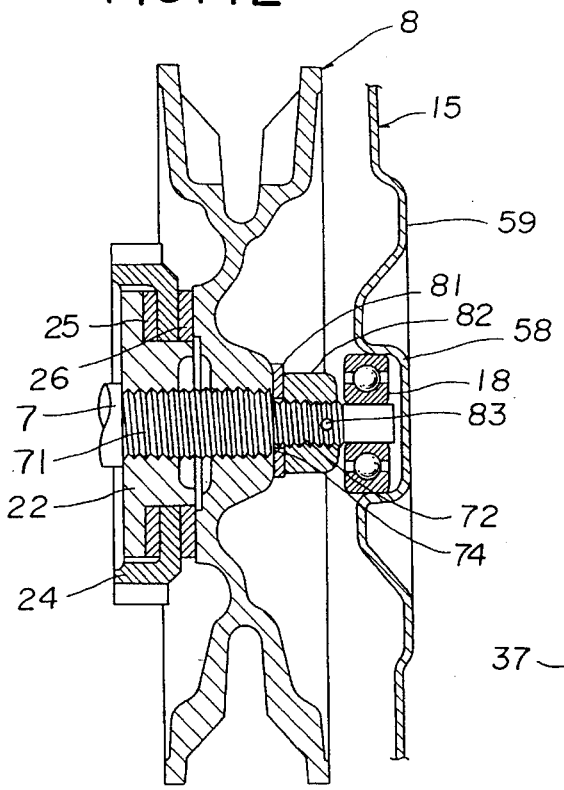
FIG. 12 is a partial sectional view showing an embodiment in which an overload prevention mechanism is not provided.

Usually a snap ring is used as the stopper 43, but a through pin may be used instead of a snap ring. As shown in FIG. 12, a castle nut 82 may be made to threadably engage with the journal portion 72 by using a washer 81 and the nut 82 instead of the wheel stopping member 40 and anchored to the journal portion 72 by a through pin 83. Further, the driving member 23 or the boss portion of the hand wheel 8 may be brought into direct contact with the bearing 18 or the wheel cover 15 without the wheel stopping member 40.

Next, the wheel cover 15 and the gear cover 16 holding the radial bearings 18, 19 respectively as mentioned above will be explained hereinafter.

Figure 8:
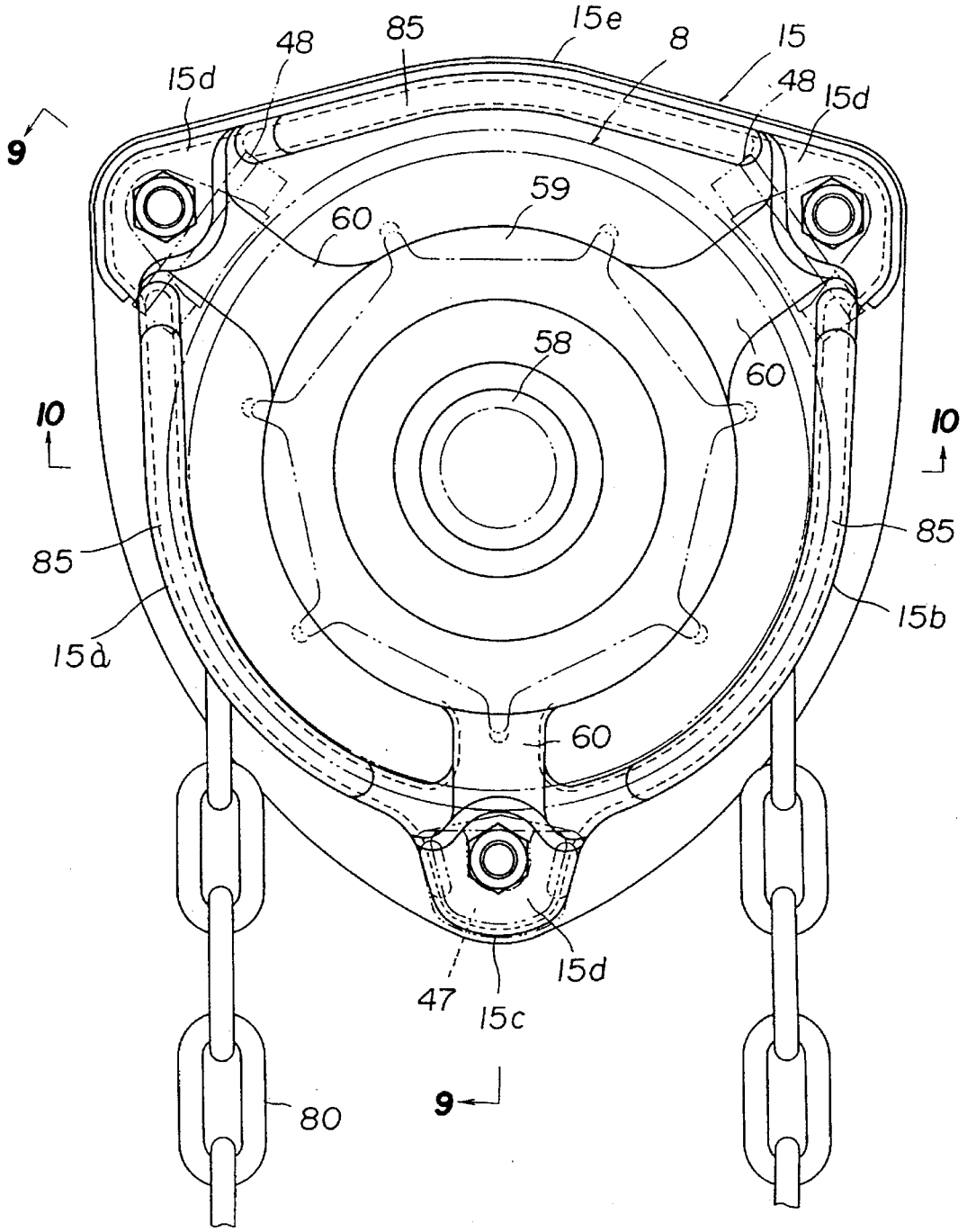
FIG. 8 is a front view showing a wheel cover.

When viewed from the front as shown in FIG. 8, the wheel cover 15 has passage openings 15*a*, 15*b* for passing the hand chain on the opposite left and right sides and a short cover side wall 15*c* between these passage openings 15*a*, 15*b*. A cover holding member 47 fixed to the first side plate 1 is connected to the inside of the cover side wall 15*c*, and hand chain guides 48 are disposed at tightening portions 15*d* for the stay bolts 12 in the wheel cover 15.

Figure 7:
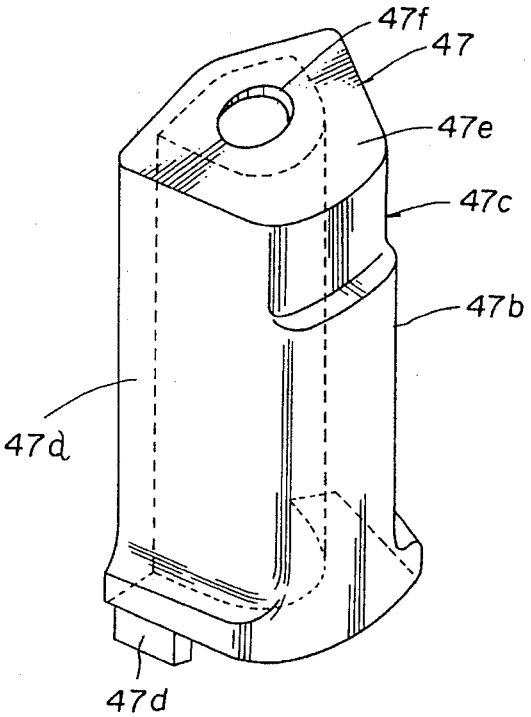
FIG. 7 is a perspective view showing a cover holding member.

As shown in FIG. 7, the cover holding member 47 has side surfaces 47*a*, 47*b* which serve to define lower opening edges of the passage openings 15*a*, 15*b* and a cover receiving portion 47*c* having a seat surface 47*e* onto which the inside of the wheel cover 15 sits and is adapted to receive the cover side wall 15*c* of the wheel cover 15. An outer surface of the cover receiving portion 47*c* is formed in an arcuate shape so that the cover receiving portion 47*c* can be held by the cover side wall 15*c*. Further, the cover holding member 47 has a pair of angular projections 47*d* so formed at its end face on the side of the first side plate 1 as to fit into a pair of angular fitting holes 49 of the side plate 1. For positioning and an insertion opening 47*f* is formed in the seat surface 47*e* onto which the inside of the wheel cover 15 sits so that the stay bolt 12 running between the side surfaces 47*a*, 47*b* passes therethrough.

Figure 9:
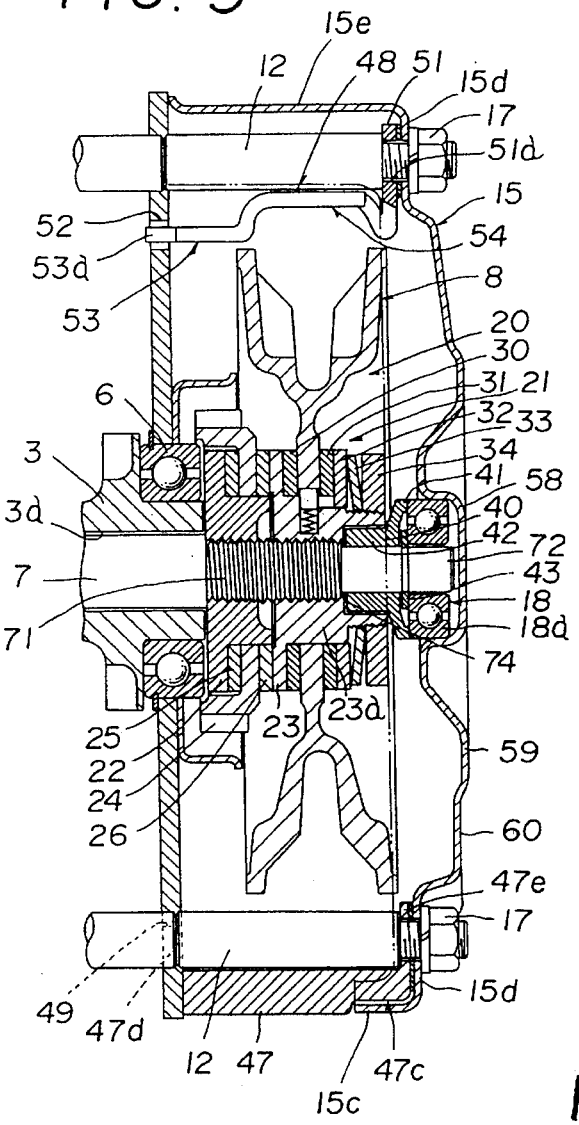
FIG. 9 is a sectional view taken along the 9—9 line in FIG. 8.
Figure 11:
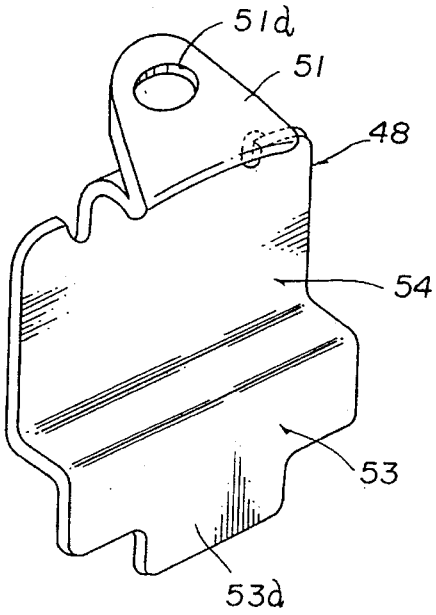
FIG. 11 is a perspective view showing a hand chain guide.
Figure 10:
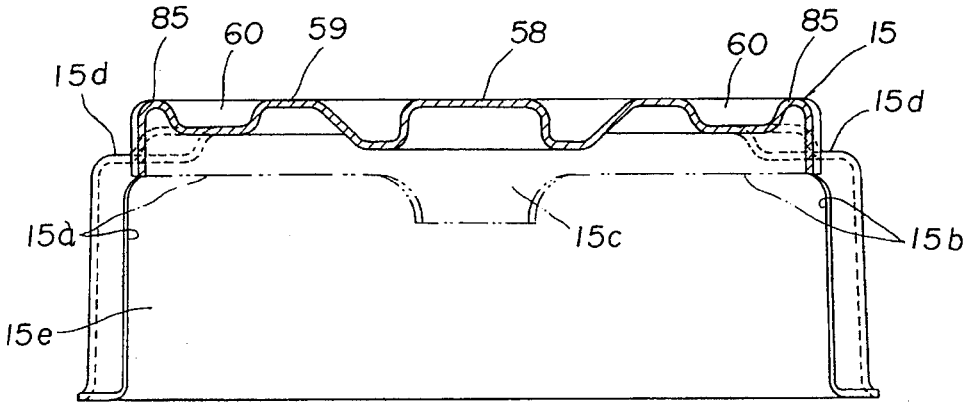
FIG. 10 is a sectional view taken along the 10—10 line in FIG. 8 but showing only the wheel cover.

As shown in FIGS. 9 and 11, the hand chain guide 48 comprises an attached portion 51 which is interposed between the stay bolt 12 and a tightened portion 15*d* of the wheel cover 15 by the stay bolt 12, has an outer surface coinciding with the inner surface of the cover side wall 15*e* extending to the tightened portion 15*d* and has a bolt passing opening 51*a* formed in the flat face, a held portion 53 which has the angular projections 53*a* adapted to fit into an angular fitting hole 52 of the first side plate 1 for positioning so as to be held by the side plate 1 and a guide portion 54 which is located between the attached portion 51 and the held portion 53 facing the hand wheel 8 and serves to guide the hand chain.

Thus, the cover holding member 47 and the pair of hand chain guides 48, 48 are fixedly secured between the first side plate 1 and the wheel cover 15 by tightening a nut 17 relative to a stay bolt 12, and a position of the wheel cover 15 relative to the first side plate 1 is set by fitting the angular projections 47*d*, 53*a* of the cover holding member 47 and the hand chain guides 48, 48 into the angular openings 49, 52 respectively.

That is, the position of the cover holding member 47 relative to the wheel cover 15 is secured by receiving the cover side wall 15*c* in the receiving portion 47*c* of the cover holding member 47. The positions of the hand chain guides 48, 48 relative to the wheel cover 15 is secured by abutting the respective attached portions 51 of the hand chain guides 48, 48 against the inner surface of the cover side wall 15*e* and by fixing them by means of a spot welding or the like. Therefore, while the respective angular projections 47*d*, 53*a* of the cover holding member 47 and the hand chain guides 48, 48 serve as the positioning member, the respective angular openings 49, 52 serve as the positioning opening into which the angular projections 47*d*, 53*a* fit, so that the wheel cover 15 can be positioned relative to the first side plate 15 and fixedly secured at the predetermined position by tightening the nut 17 relative to the stay bolt 12.

Figure 5:
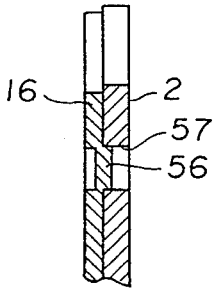
FIG. 5 is an enlarged sectional view showing a positioning arrangement between a gear cover and a second side plate.

A positioning member 56 generally comprising a knock pin for setting a position of the gear cover 16 relative to the second side plate 2 and a positioning concaved portion 57 into which the positioning member 56 fits for positioning are provided between the gear cover 16 and the second side plate 2 to which the gear cover 16 is attached. The positioning member 56 is generally provided on the side of the gear cover 16 and may be provided by a knock pin as a separate member from the gear cover 16. But, as shown in FIGS. 1 and 5, it is preferable to swell out the gear cover 16 to form the positioning member 56 as a low protrusion by a burring process.

As noted above, since the positionings between the wheel cover 15 and the first side plate 1 and between the gear cover 16 and the second side plate 2 are attained by providing the positioning member and the positioning concaved portion therebetween, it is possible to set the positions of the respective bearings 18, 19 based on the respective side plates 1, 2 supporting the load sheave 3. Therefore, it is possible to accurately make the axis of the driving shaft 7 coincide With the axis of the load sheave 3.

As shown in FIGS. 1, and 9, the wheel cover 15 has a concaved portion 58 holding the bearing 15, an annular rib 59 surrounding the concaved portion 58, reinforcement ribs 60 radially extending frown the annular rib 59 toward the tightened portions 15*d* to be tightened by the stay bolts 12 and terminating there and reinforcement ribs 85 connecting both the tightened portions 15*d* in the upper section of the wheel cover 15 and the tightened portion 15*d* in the lower section thereof respectively. Thus, the wheel cover 15 is so formed from a metal plate as to have those ribs 59, 60, 85 and the concaved portion 58 for reinforcement and to prevent a shift of the position of the bearing 18 held by the concaved portion 58.

That is, since the holding portion for holding the bearing 18 is reinforced by the concaved portion 58, the annular rib 59 and the reinforcement ribs 60 connecting to the annular rib 59 and is joined to the stay bolt 12 continuously through the reinforcement ribs 60 as well as further the reinforcement rib 58 is provided between the tightened portions 15*d* to be tightened by the stay bolt 12, even though a portion of the wheel cover 15 is deformed by an external force, it is possible to prevent any shifting of the position of the holding portion or to minimize it so that the axis position of the driving shaft 7 can be maintained.

Further, since an outer peripheral portion of the gear cover 16 is swelled out to form a swelled-out portion 16*a* for enhancing the rigidity of a central portion and thus bearing 19 and the bearings 61, 62 which are disposed in that central portion as shown in FIG. 4. Even if an external force is applied thereto, it is possible to prevent the position of the bearing 19 from being shifted. Therefore, the driving shaft 7 supported by the wheel cover 15 and the gear cover 16 through the bearings 18, 19 can be held at the predetermined axial position by the above-mentioned constructions of the wheel cover 15 and the gear cover 16 even if an impact is imposed from outside. Thereupon, it is possible to avoid an interference with the load sheave 3 which might be caused by the axial shift and to construct a durable chain block.

Incidentally, in FIG. 2, numerals 63, 64 designate load chain guides for guiding the load chain 4 approaching between the side plates 1, 2 to the load sheave 3, and numerals 65 is a chain kicker disposed directly below the load sheave 3 for restraining an inclination in the approaching direction, of the load chain 4 approaching between the side plates 1, 2 so as to mesh with the load sheave 3. These load chain guides 63, 64 and the chain kicker 65 are fixedly secured between the side plates 1, 2, and the no load side chain guide 63 is provided with an engaging portion 66 adapted to engage with a no-load side end portion of the load chain 4.

Figure 13:
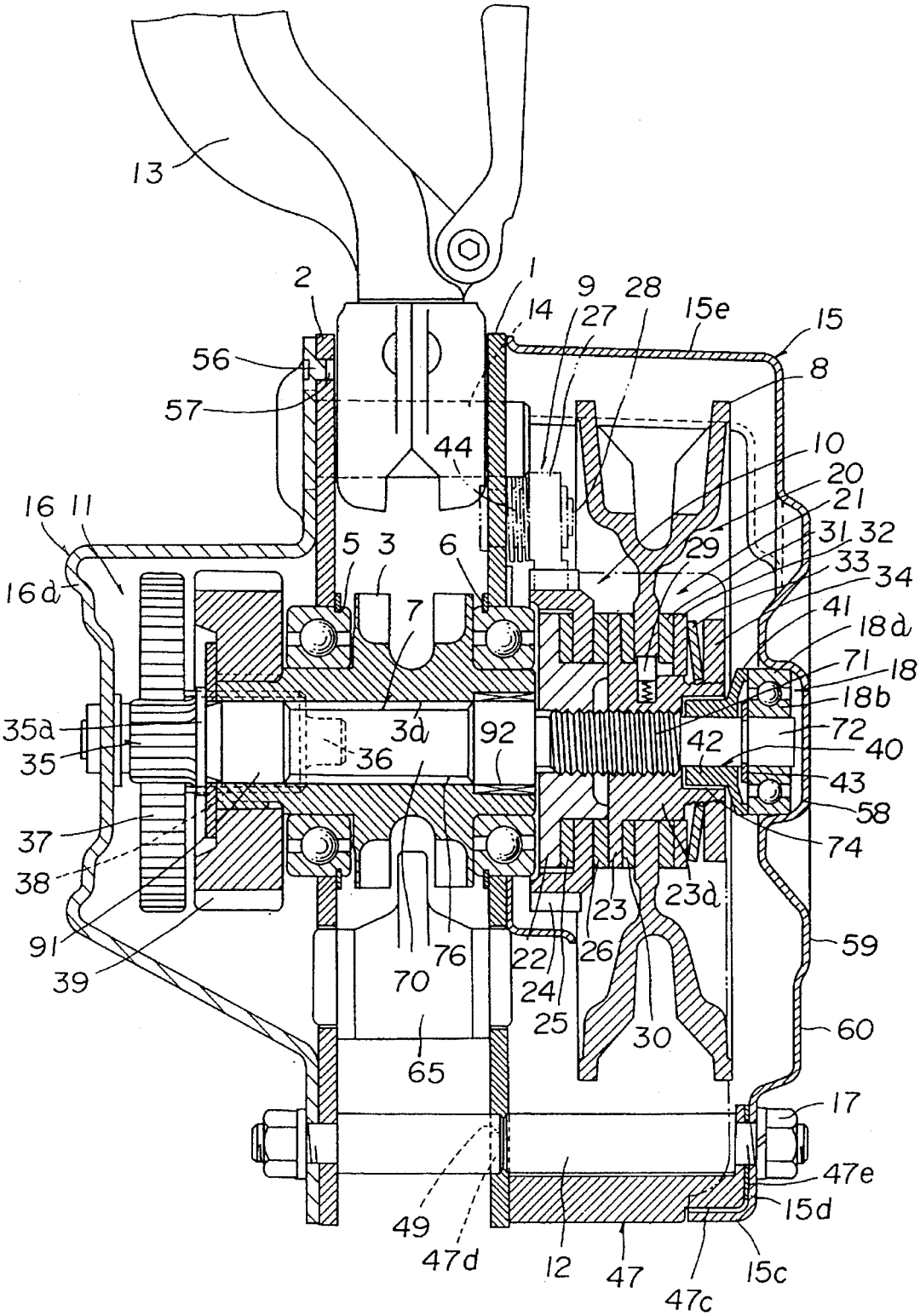
FIG. 13 is a vertical sectional view showing a second embodiment of a manual chain block according to the present invention.
Figure 16:
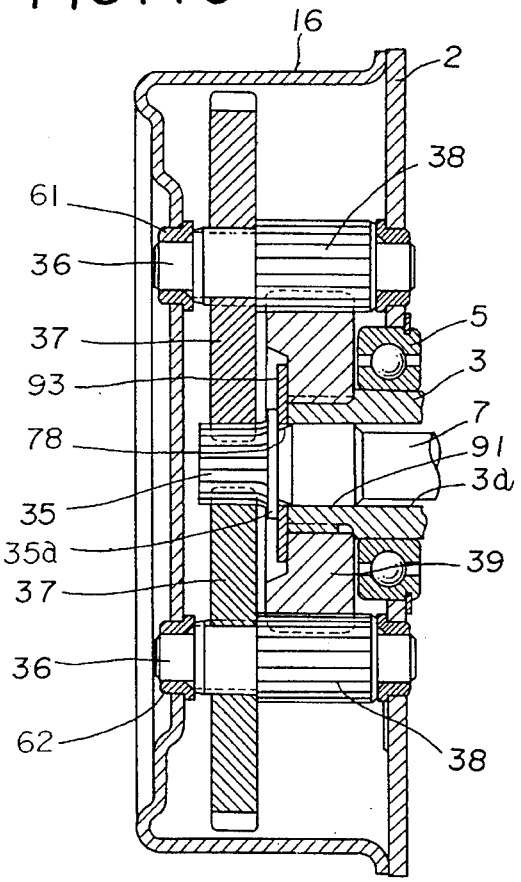
FIG. 16 is a partial horizontal sectional view showing only the reduction gear mechanism.

In the above-mentioned embodiment, though the driving shaft 7 is supported at its opposite end portions by the radial bearings 18, 19, as shown in FIG. 13, the radial bearing 19 to be disposed in the gear cover 16 of both the radial bearings 18, 19 may be omitted, a shaft portion thereof on axial one end side, namely on the actuating mechanism side for supporting the actuating mechanism 20 may be supported by the radial bearing 18 disposed in the wheel cover 15, a first and a second bearings 91, 92 may be disposed between the driving shaft 7 and the shaft bore 3*a* of the load sheave 3 on the reduction gear mechanism side and the actuating mechanism side so that the driving shaft 7 can be supported at its three points by those bearings 91, 92 and the radial bearing 18, and the first gear 35 and a flange portion 35*a* continued to the first gear 35, having a larger diameter than a shaft bore diameter of the load sheave 3 for blocking the movement of the driving shaft 7 toward the actuating mechanism side may be formed integrally in the reduction gear mechanism side shaft end portion of the driving shaft 7.

Figure 15:
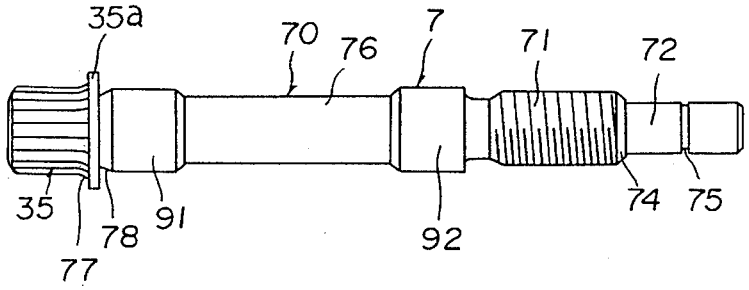
FIG. 15 is a front view showing only the driving shaft.

When explaining this second embodiment more in detail, as shown in FIG. 15, the driving shaft 7 according to the second embodiment has the actuating mechanism side shaft portion and the reduction gear mechanism side shaft portion between which an intermediate shaft portion 70 to be passed through the shaft bore 3*a* of the load sheave 3 is provided. The actuating mechanism side shaft portion comprises a threaded shaft portion 71 adapted to be threadably engaged with the driven hub 22 and the driving member 23. An extended shaft portion 72 formed by extending an axial outer side of the threaded shaft portion 71 with a receiving stepped portion 74 is formed between the threaded shaft portion 71 and the extended shaft portion 72 by making a diameter of the extended shaft portion 72 smaller than that of the threaded shaft portion 71. A fitting groove 75 for the stopper 43 is formed at an intermediate position of the extended shaft portion 72. The first gear 35 and the flange portion 35*a* are formed integrally in the reduction gear mechanism side shaft portion, and the intermediate shaft portion 70 has a reduced diameter shaft portion 76 formed for providing first and second bearings 91, 92.

Figure 14:
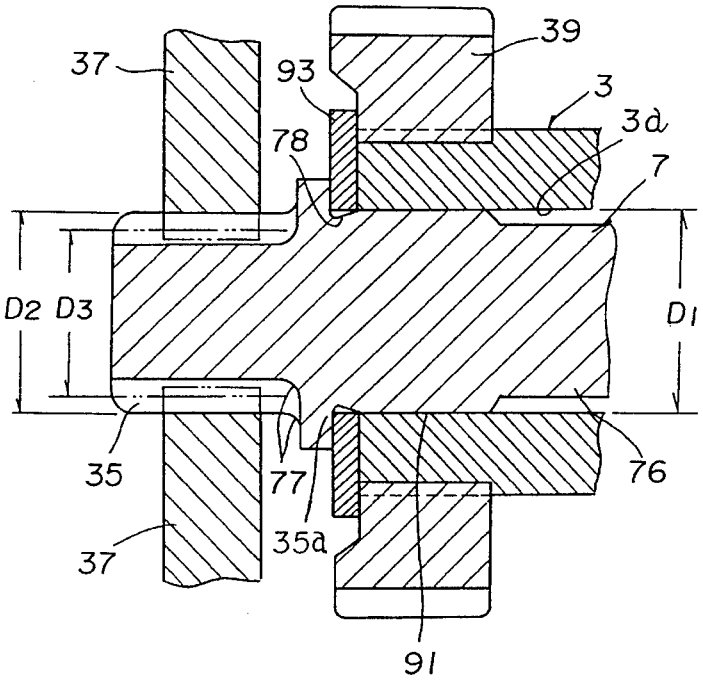
FIG. 14 is an enlarged sectional view showing a shaft portion of the driving shaft on the reduction gear mechanism side.

The first gear 35 and the flange portion 35*a* are formed integrally mainly by means of cold forging, and, as shown in FIG. 14, the first gear 35 has a tip diameter D2 made substantially equal to the outer diameter of the driving shaft 7. More specifically the outer diameter D1 of the shaft portion for forming the first and the second bearings 91, 92 and a pitch circle diameter D3 is made smaller than the outer diameter D1. The flange portion 35*a* formed continuously on the inside of the first gear 35 is so formed as to have a larger diameter than the outer diameter D1 of the shaft portion of the driving shaft 7 by forging.

When the first gear 35 and the flange portion 35*a* are formed integrally by means of cold forging in that way, since the formation is carried out by applying a pressure from the side of the shaft end portion of the driving shaft 7, a build up portion 77 can be so formed between the first gear 35 and the flange portion 35*a* as to run in a curved configuration from both the tip portion and the bottom portion of the first gear 35 to the flange portion 35*a*. Thereupon, since the first gear 35 and the flange portion 35*a* are joined through the build up portion 77, it is possible to obtain sufficient strength at the time of gear forming by means of cold forging in spite of the fact that the pitch circle diameter D3 of the first gear 35 is smaller than the shaft portion outer diameter D1 of the driving shaft 7. Incidentally, though a downsizing can be attained by making the tip diameter D2 of the first gear 35 equal to the outer diameter D1 of the driving shaft 7 and making the pitch circle diameter D3 smaller than the outer diameter D1, the tip diameter D2 may be made larger than the outer diameter D1.

In the second embodiment, a washer 93 having a larger diameter than a cylindrical shaft outer diameter of the load sheave 3 is interposed between the flange portion 35*a* and the shaft end portion of the load sheave 3 to restrain any axial movement of the driving shaft 7 toward the actuating mechanism side and to prevent a slip-out of the fourth gear 39 of the reduction gear mechanism 11 coupled to the cylindrical shaft of the load sheave 3 through splines. Numeral 78 in FIGS. 13 through 15 designates a grinding margin for finishing the shaft portion forming the first bearing 91 by means of grinding.

Also in the second embodiment having the above-mentioned construction, since the actuating mechanism side shaft portion of the driving shaft 7 is supported by the radial bearing 18 disposed in the wheel cover 15, it is possible to improve the supporting rigidity of the actuating mechanism side shaft portion. Therefore, when the hand wheel 8 of the actuating mechanism 20 actuated through the hand chain 80, even though a large load acts on the driving shaft 7, it is possible to decrease shaft deflection and to prevent a shaft deformation.

As a result, it becomes possible to improve the transmission efficiency of the driving force transmitted from the hand wheel 8 to the load sheave 3, to improve its operability and to resolve a deficiency such that the hand wheel 8 is brought into contact with the chain guide (not illustrated) or the wheel cover 15 to generate undesirable noises.

Further, since the axial movement of the driving shaft 7 can be restrained by the driven hub 22 of the transmission mechanism 10 and the flange portion 35*a*, it is unnecessary otherwise to restrain the axial movement of the driving shaft 7. Of course for the radial bearing 18 and also the first the second bearings 91, 92 and it is enough to merely have the bearing function. As a result, it is possible prevent obstruction of the rotation of the driving shaft 7 or lowering of the bearing efficiency and damage of the bearing which might be caused by imposing a load by restraint of the axial movement of the respective bearings 18, 91, 92.

In addition, in the second embodiment, since the driving shaft 7 is supported at its three points by the radial bearing 18 and the first and the second bearings 91, 92, it is possible to shorten a span between the respective bearings. Therefore, it becomes possible to restrain any shaft deflection of the driving shaft in its entirety, to further improve the rotatability of the driving shaft 7 and to attain the further improvement of the transmission efficiency.

Incidentally, though the first and the second bearings 91, 92 are formed in the opposite side portions of the driving shaft 7 which are formed by providing the small diameter shaft portion 76 in the intermediate portion 70 in the above-mentioned construction, a metal bearing may be used or a rolling bearing such as a needle bearing and a ball bearing may be used. The second embodiment shown in FIG. 13 employs rolling bearing such as a needle bearing or a ball bearing as the second bearing 92 on the actuating mechanism side.

Though the first and the second embodiments have an overload prevention mechanism 21 assembled in the actuating mechanism 20, that mechanism 21 is not always needed. When an overload prevention mechanism 21 is not provided, as shown in FIG. 12, the boss portion of the hand wheel 8 is made to threadably engage with the threaded portion 71 of the driving shaft 7.

Though either of the radial bearings 18, 19 are held directly by the wheel dover 15 and the gear cover 16 respectively, as shown in FIGS. 17 through 20, they may be held by other members separated from the covers 15, 16.

Figure 17:
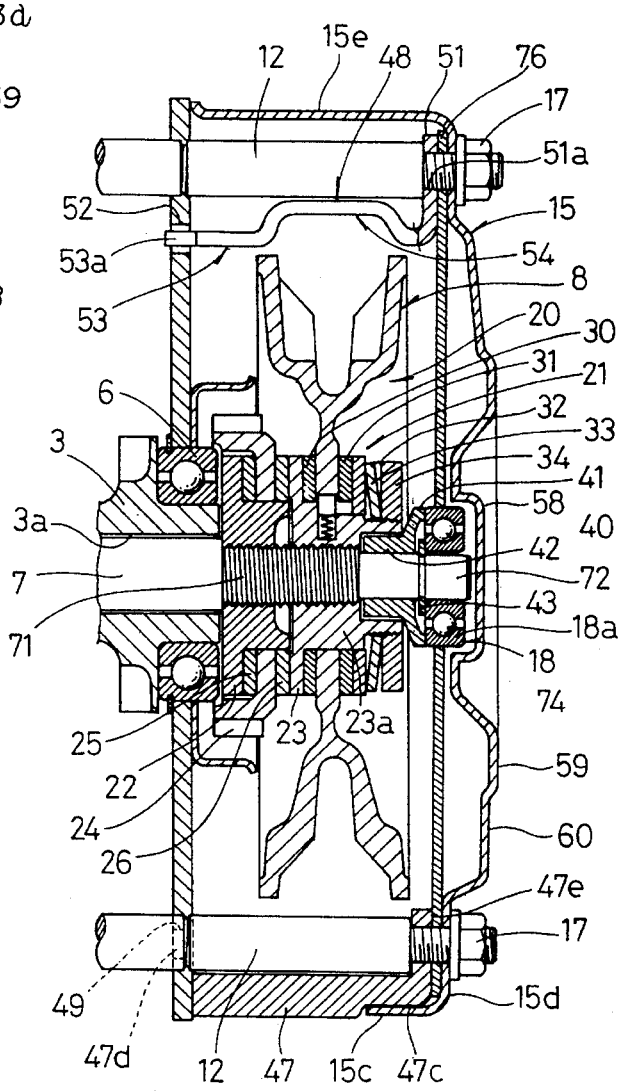
FIG. 17 is a sectional view corresponding to FIG. 9 and showing another embodiment.

That is, as shown in FIG. 17, a support plate 76 may be disposed inside of the wheel chain 15 and is tightened together with the wheel cover 15 by tightening the nut 17 to the stay bolt 12 for fixing the wheel cover 15 to the side plate 1 so that the radial bearing 18 can be held by the support plate 76.

Figure 18:
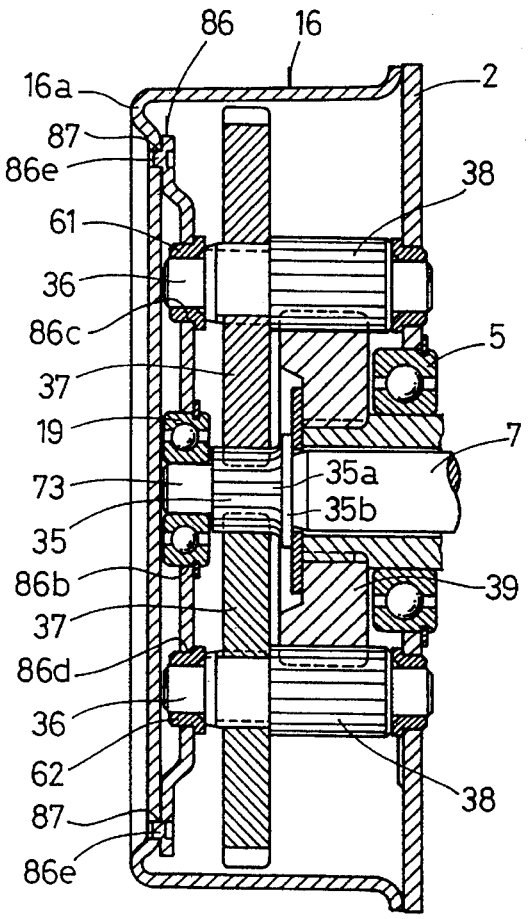
FIG. 18 is a sectional view corresponding to FIG. 4 and showing further another embodiment.
Figure 19:
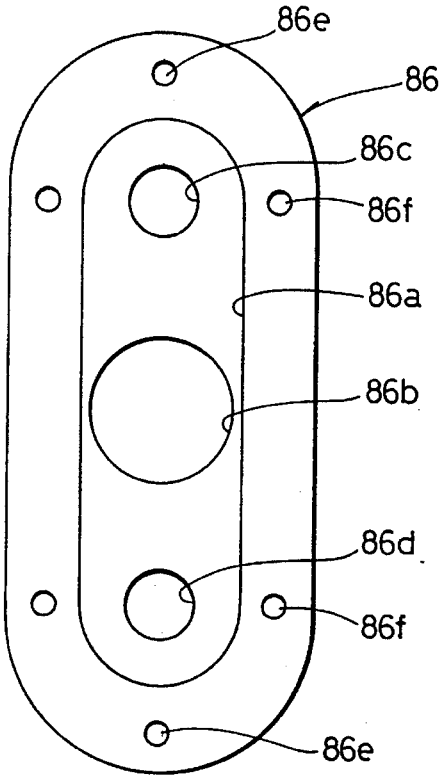
FIG. 19 is a plan view showing a press plate for use in the embodiment of FIG. 18.
Figure 20:
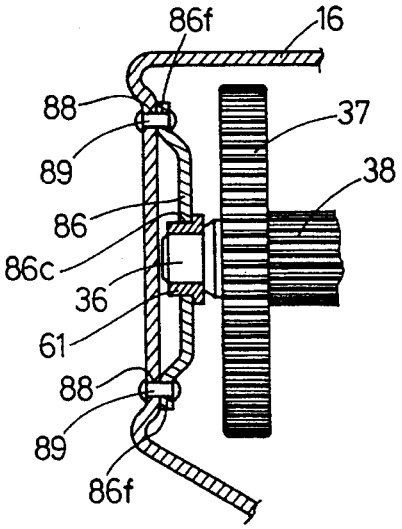
FIG. 20 is a partial sectional view showing segmentally a portion to be secured by a rivet in the embodiment of FIG. 18.

Further, as shown in FIG. 18, a press plate 86 may be disposed inside of the gear cover 16 so that the radial bearing 19 and the bearings 61, 62 for the intermediate shafts 36, 36 can be supported by the press plate 86. This press plate 86 comprises an elongate metal plate which is concaved at its central portion to form a concaved portion 86*a* in which support openings 86*b*, 86*c*, 86*d* for the respective bearings 19. 61, 62 are formed as shown in FIG. 19 and has an outer peripheral portion in which two low positioning knock pins 86*e* projecting as low protrusions as shown similarly in FIG. 5 and four rivet openings 86*f* are formed. The gear cover 16 has two positioning openings and four rivet openings 88 formed correspondingly so that the press plate 86 can be fixedly secured to the gear cover 16 by rivets 89 passed through the rivet openings 86*f*, 88 under the condition that the knock pins 86*e* are fitted into the positioning openings 87.

Incidentally, when the press plate 86 is fixedly secured to the gear cover 16, a spot welding may be employed instead of the above-mentioned rivets 89.

Since the radial bearing 18 is held within the concaved portion 58 of the wheel cover 15, it is possible to improve the strength of the holding portion. But, like the radial bearing 19 of the gear cover 16, it may be held by a through opening of the cover wall.

Figure 21:
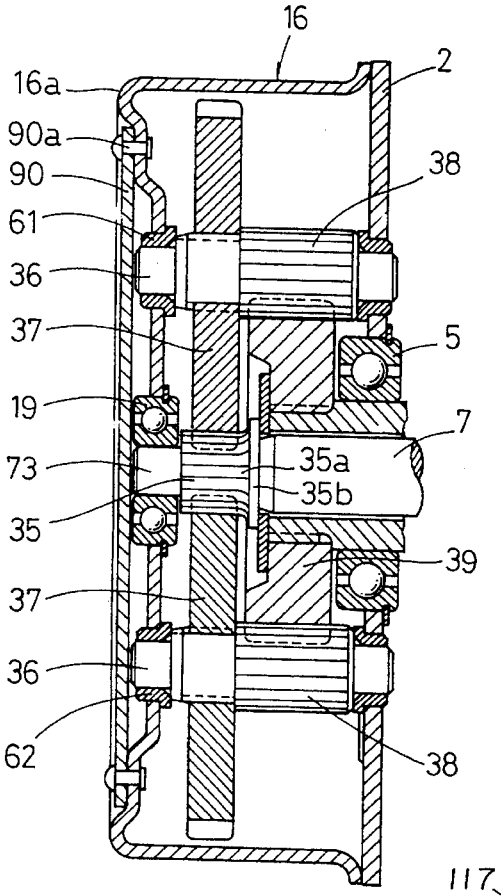
FIG. 21 is a sectional view showing an embodiment employing a cover member.
Figure 22:
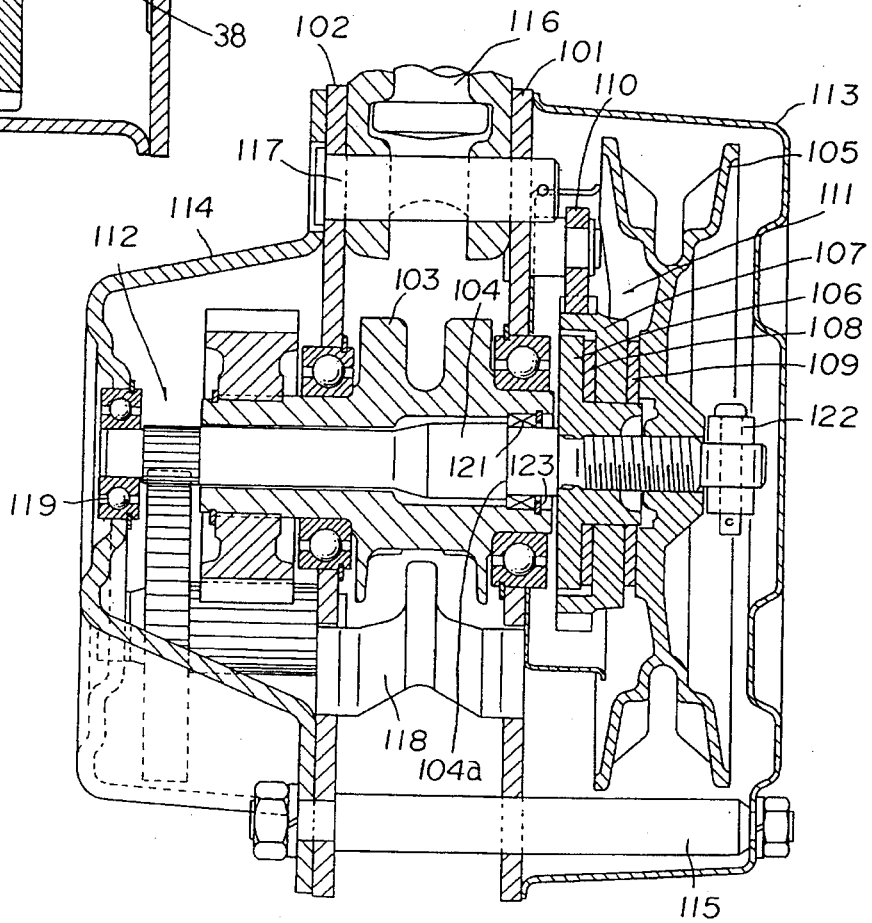
FIG.22 (PRIOR ART)
FIG. 22 is a sectional view showing a conventional embodiment.

Further, as shown in FIGS. 1 and 4, when the radial bearing 19 and the bearings 61, 62 are supported by the gear cover 16, the respective bearings 19, 61, 62 are exposed outside the gear cover 16. But, they can be concealed by a cover member 90 secured to the outside of the cover 16 by pins 90*a* as shown in FIG. 21. Thereupon, the cover member 90 may be secured to the gear cover 16 by means of spot welding.

Further, in the second embodiment, when the first and the second bearings 91, 92 are provided, three-point supporting can be attained together with radial bearing 18. But, one of the first and the second bearings 91, 92, preferably the second bearing 92 on the actuating mechanism side may be omitted to attain a two-point supporting. Further, the driving shaft 7 may be supported by a substantially whole portion of the shaft bore 3*a* of the load sheave 3 in its longitudinal direction by omitting the small diameter shaft portion 76.

This invention has been described in detail with particular reference to preferred embodiments thereof, but it will be understood that variations and modifications can be effected within the spirit and scope of the invention.

What is claimed is:

1. A manual chain block comprising:

a pair of first and second side plates;

a load sheave having a shaft bore and supported rotatably between said side plates:

an actuating mechanism comprising a hand wheel;

a driving shaft passing through said shaft bore of said load sheave and driven by means of said actuating mechanism, one end portion of said driving shaft being connected to said actuating mechanism;

a reduction gear mechanism disposed at an other end portion of said driving shaft;

a wheel cover, attached to said first side plate, for covering said actuating mechanism;

a gear cover attached to said second side plate, for covering said reduction gear mechanism, wherein said driving shaft comprise is a threaded shaft portion along which said hand wheel is threadedly movable and an extending shaft portion extending axially outwardly from said threaded shaft portion;

a radial bearing for supporting said extending shaft portion of said driving shaft provided at a portion of said wheel cover;

a wheel stopping means having a restraint portion for controlling axial movement of said hand wheel and a stopper for fixing said wheel stopping means to said driving shaft provided at a portion of said driving shaft extending between said threaded shaft portion and an end portion of said extending shaft portion supported by said radial bearing.

2. A manual chain block as set forth in claim 1, wherein a radial bearing for supporting said driving shaft is disposed on a side of said;

said driving shaft is supported rotatably at its axial opposite end portions by said wheel cover and said gear cover through the respective bearings separately from said load sheave; and said load sheave is supported rotatably by said first and said second side plates with a predetermined gap kept between the inner peripheral surface of the shaft bore thereof and the outer peripheral surface of said driving shaft.

3. A manual chain block as set forth in claim 2, wherein said actuating mechanism is provided with a mechanical brake, and said threaded shaft portion is adapted to be rotated interlockingly by the hand wheel; a journal portion supported by the wheel cover through the bearing with said journal portion being inserted and held into a wheel stopping member having a restraint portion opposed to an outer ring of said radial bearing held by said wheel cover to restrain its axial movement by contact with the outer ring and a receiving portion for receiving an axial movement of said hand wheel.

4. A manual chain block as set forth in claim 3, wherein said journal portion is smaller in diameter than the threaded shaft portion, between the threaded shaft portion and and the journal portion there is provided a receiving stepped portion, and a stopper of said wheel stopping member is anchored in said journal portion outside a holding portion of said wheel stopping member.

5. A manual chain block as set forth in claim 2, wherein between said wheel cover and said first side plate to which that cover is attached and between said gear cover and said second side plate to which that cover is attached there are provided both positioning members for setting the positions of the covers relative to the side plates and positioning concaved portions adapted to engage with said positioning members respectively.

6. A manual chain block as set forth in claim 1, wherein said driving shaft, which is supported by said radial bearing on one axial end, is supported on its other axial end by a bearing interposed between the shaft bore of said load sheave and said driving shaft passing through said shaft bore; and a first gear of said reduction gear mechanism and a flange portion thereof are joined continuously to said first gear and have a larger outer diameter than that of said driving shaft to block the movement of said driving shaft toward the actuating mechanism side and are formed integrally in the reduction gear mechanism side shaft end portion of said driving shaft on the axial other end thereof.

7. A manual chain block as set forth in claim 6, wherein a first and a second bearings are interposed between said load sheave and said driving shaft passing through said shaft bore of said load sheave on the reduction gear mechanism side and on the actuating mechanism side respectively, so that said driving shaft can be supported at three points by said bearings and the radial bearing serving to support the extended shaft end portion thereof on the actuating mechanism side.

8. A manual chain block as set forth in claim 1, wherein said wheel cover comprises a concaved portion adapted to hold said bearing, an annular rib surrounds the concaved portion and a plurality of reinforcement ribs extend radially from said annular rib.

9. A manual chain block as set forth in claim 8, wherein the reinforcement ribs extending radially from said annular rib reach portions of the wheel cover which are fixed onto the first side plate by stay bolts and terminate thereat.

* * * * *